US006183024B1

(12) United States Patent
Schultz et al.

(10) Patent No.: US 6,183,024 B1
(45) Date of Patent: Feb. 6, 2001

(54) TILT-LATCH FOR A SASH WINDOW

(75) Inventors: Steven E. Schultz, Demotte, IN (US); James G. Prete, Chicago, IL (US)

(73) Assignee: Ashland Products, Inc., Lowell, IN (US)

( * ) Notice: Under 35 U.S.C. 154(b), the term of this patent shall be extended for 0 days.

(21) Appl. No.: 09/306,966

(22) Filed: May 7, 1999

(51) Int. Cl.[7] ..... E05C 1/10

(52) U.S. Cl. ..... 292/175; 292/337; 292/DIG. 47; 49/181

(58) Field of Search ..... 292/175, 337, 292/42, 145, DIG. 35, DIG. 38, DIG. 47, DIG. 53; 49/185, 184, 183, 181

(56) References Cited

U.S. PATENT DOCUMENTS

| | | | | |
|---|---|---|---|---|
| 16,228 | | 12/1856 | Copeland . | |
| 1,781,729 | | 11/1930 | Major . | |
| 2,568,273 | | 9/1951 | Clark . | |
| 2,965,935 | | 12/1960 | Olsen . | |
| 3,080,621 | | 3/1963 | Mendelsohn . | |
| 3,122,797 | | 3/1964 | Segre . | |
| 3,850,464 | * | 11/1974 | Bisbing et al. | 292/175 |
| 4,167,835 | | 9/1979 | Nobes et al. . | |
| 4,400,026 | | 8/1983 | Brown, Jr. . | |
| 4,475,311 | | 10/1984 | Gibson . | |
| 4,553,353 | | 11/1985 | Simpson . | |
| 4,578,903 | | 4/1986 | Simpson . | |
| 4,581,850 | | 4/1986 | Simpson . | |
| 4,622,778 | | 11/1986 | Simpson . | |
| 4,669,765 | | 6/1987 | Ullman . | |
| 4,676,081 | * | 6/1987 | Craig | 70/169 |
| 4,790,579 | | 12/1988 | Maxwell et al. . | |
| 4,791,756 | | 12/1988 | Simpson . | |
| 4,824,154 | | 4/1989 | Simpson . | |
| 4,837,975 | | 6/1989 | Simpson . | |
| 4,901,475 | | 2/1990 | Simpson . | |
| 4,917,413 | | 4/1990 | Jason et al. . | |
| 5,028,083 | | 7/1991 | Mischenko . | |
| 5,068,932 | | 12/1991 | Chang . | |
| 5,096,240 | | 3/1992 | Schultz . | |
| 5,121,951 | | 6/1992 | Harbom et al. . | |
| 5,121,952 | | 6/1992 | Jason . | |
| 5,139,291 | | 8/1992 | Schultz . | |
| 5,165,737 | | 11/1992 | Riegelman . | |
| 5,301,989 | * | 4/1994 | Dallmann et al. | 292/142 |
| 5,536,052 | * | 7/1996 | Maier | 292/63 |
| 5,618,067 | | 4/1997 | Carlson et al. . | |
| 5,669,180 | * | 9/1997 | Maier | 49/181 |
| 5,669,639 | | 9/1997 | Lawrence . | |
| 5,671,958 | | 9/1997 | Szapucki et al. . | |
| 5,806,900 | * | 9/1998 | Bratcher et al. | 292/137 |
| 5,970,656 | * | 10/1999 | Maier | 49/181 |
| 5,974,842 | * | 11/1999 | Schlack et al. | 70/208 |
| 5,996,283 | * | 12/1999 | Maier | 49/181 |

* cited by examiner

*Primary Examiner*—Teri Pham
(74) *Attorney, Agent, or Firm*—Wallenstein & Wagner, Ltd.

(57) ABSTRACT

A tilt-latch (10) is adapted for releasably securing a pivotable sash window (12) disposed within opposed guide rails (16) on a master frame (14) of a window sash assembly (11). The sash window 12 comprises a top sash rail (20), a base (22) and two stiles (24,26) connected together at their extremities. The tilt-latch 10 comprises a housing (42) adapted to be supported by the top rail (20). The housing (42) has an outward end opening (44) and a pair of sidewalls (56,58). A latch bolt (46) is disposed within the housing (42) and has a nose adapted for engaging a respective one of the guide rails (16). The sidewalls (56,58) each have a first segment (80,82) and a second segment (84,86). The first segment (80,82) has a lesser thickness $t_1$ than the second segment 84,86 providing a gap ($g_1$,$g_2$)between each sidewall (56,58) and the latch bolt (46). The first segments (80,82) are flexible to a flexed position during and upon installation wherein the first segments (80,82) do not contact the latch bolt (46), thereby allowing the latch bolt (46) to be retracted or extended through the outward end opening (44) without being obstructed by the sidewalls (56,58).

56 Claims, 6 Drawing Sheets

TILT-LATCH FOR A SASH WINDOW

TECHNICAL FIELD

The present invention relates to a tilt-latch for a pivotal sash window assembly and, more particularly to a tilt-latch mounted substantially flush in a top sash rail of a pivotal sash window.

BACKGROUND OF THE INVENTION

A pivotal sash window adapted for installation in a master frame of a sash window assembly is well-known. The sash window assembly typically has opposed, vertically extending guide rails to enable vertical reciprocal sliding movement of the sash window in the master frame while cooperatively engaged with the guide rails. The sash window has a top sash rail, a base and a pair of stiles cooperatively connected together at adjacent extremities thereof to form a sash frame, usually a rectangular frame. Typically, a pair of spaced tilt-latches are installed on, or in, opposite ends of the top sash rail.

Each tilt-latch is generally comprised of a housing having an outward end opening and a latch bolt disposed within the housing. A spring disposed within the housing generally biases the latch bolt through the outward end opening to engage the guide rails of the master frame. The latch bolt has a control button to allow for actuation of the latch bolt. An operator's finger engages the button to actuate the latch bolt wherein the latch bolt is retracted into the housing. This releases the latch bolt from the guide rail. When the latch bolts of the opposed tilt-latches are actuated simultaneously, the sash window can then be pivoted from the master frame.

A tilt-latch mounted in a top sash rail is typically called a flush-mount tilt-latch. An example of this type of tilt-latch is shown in U.S. Pat. No. 5,139,291, assigned to Ashland Products, Inc., the assignee of the present invention. To accommodate the flush-mount tilt-latch in the top rail, a header slot is punched or routed in the top rail. The slot forms a pair of opposing, longitudinal header rails. The tilt-latch disclosed in U.S. Pat. No. 5,139,291 has a longitudinal groove on opposing sidewalls of the latch. This tilt-latch is installed in the header slot of the top rail by inserting the latch from the side of the sash frame wherein the longitudinal grooves receive a respective one of the header rails wherein the tilt-latch is retained in the top sash rail.

Other flush-mount tilt-latches have been designed to be preferably installed by inserting the tilt-latch perpendicularly into the header slot from the top of the top sash rail. These tilt-latches are typically "snapped into" the header slot although the tilt-latches can usually also be slid into the header slot from the side of the sash frame. To retain these "snap-in" type latches in the top rail, the latches typically have a plurality of flared tabs, or ramps, on sidewalls and/or a rear wall of the tilt-latch. The tabs can be rigid or resilient. In either case, the tilt-latch is snapped into the header slot wherein the tabs abut a bottom surface of the top sash rail. A cover of the housing abuts a top surface of the top rail. Thus, the header rail is grasped cooperatively by the housing cover and the tabs.

FIG. 1 discloses a side-elevational view of a prior art snap-in type tilt-latch 1. FIG. 2 discloses a partial cross-sectional view of the tilt-latch 1 of FIG. 1 installed in a header slot 2 of a top sash rail 3. The tilt-latch 1 has a housing 4 and a latch bolt 5 within the housing. The housing 4 has a plurality of resilient tabs 6 on sidewalls 7 of the housing 4 (one tab 6 shown on each sidewall 7 in FIG. 2).

The tabs 6 have an inverted U-shaped slot 6*a* cut around the tabs 6 that allows the tabs 6 to flex inward towards the latch bolt 5. When the tilt-latch 1 is installed into the header slot 2, an inclined surface 8 of the tab 6 frictionally engages the header rail 2*a* wherein the tab 6 flexes inwardly until it passes completely by the header rail 2*a* where, ideally, it snaps back to the position shown in FIG. 2. In this installed state, the header rails 2*a* are grasped cooperatively by a housing cover 9 on a top surface of the header rail 2*a* and by the tabs 6 on a bottom surface of the header rail 2*a*. In certain instances, due to irregularities in the dimensions of the tilt-latch 1 and/or the top rail 3, the tabs 6 do not snap back to their normal position upon installation. Thus, as shown by the phantom lines in FIG. 2, the tabs 6 remain in an inwardly flexed condition wherein the tabs 6 may engage the latch bolt 5. This engagement restricts, obstructs and/or prevents movement of the latch bolt 5. Thus, the latch bolt 5 can be left in a partially retracted or retracted state that could allow the tilt-latch 1 to disengage from the guide rail allowing the sash window to pivot uncontrollably from the window assembly. Accordingly, the engagement problem can render the tilt-latch 1 inoperable.

Another type of snap-in tilt-latch can have rigid tabs extending from sidewalls of the housing. Such a prior art latch is shown in FIGS. 3 and 4. These tabs 13 do not have a slot cut around a portion of their peripheries but extend integrally from the sidewall of the latch. As shown in FIG. 4, the sidewall 17 is of a thickness that does not allow easy flexing upon installation. Furthermore, the latch bolt 19 fills the entire housing 21 preventing the sidewalls 17 from flexing inward a suitable distance for installation. For installation, the header rail must flex as the tilt-latch is snapped into the header slot. If the rigid tabs 13 do not snap back to their original position upon installation, the sidewall can be forced inward thus engaging the latch bolt. Again, this would restrict or prevent movement of the latch bolt making the tilt-latch inoperable.

The present invention is provided to solve these and other problems.

SUMMARY OF THE INVENTION

It is an object of the present invention to provide a tilt-latch adapted for releasably securing a pivotable sash window to a master frame of a sash window assembly.

The master frame has opposed, vertically extending guide rails. The sash window has a top sash rail, a base and a pair of stiles cooperatively connected together at adjacent extremities to form a frame. The top sash rail includes a pair of opposing header slots. Each of the header slots forms a pair of opposing, longitudinal header rails.

According to a first aspect of the invention, a housing is adapted to be supported by the top rail. The housing has an outward end opening. A latch bolt is disposed within the housing and has a nose adapted for engaging a respective one of the guide rails. The housing further has a sidewall that flexes upon installation of the latch into the top sash rail. In one preferred embodiment, the sidewall has a first segment and a second segment, the first segment having a lesser thickness than the second segment providing a gap between the sidewall and the latch bolt. In another aspect of the invention, a pair of sidewalls are provided, each sidewall having a first segment and a second segment wherein the first segment has a lesser thickness than the second segment providing a gap between the sidewall and the latch bolt.

According to another aspect of the invention, the tilt-latch has means for biasing the latch bolt through the outward end opening that comprises a spring positioned between the latch bolt and the housing. An actuator is connected to the latch bolt. A tab can extend from the housing for engaging a respective one of the stiles.

According to a further aspect of the invention, the tilt-latch is adapted to be inserted into the top rail wherein the first segment flexes into the gap when the tilt-latch is inserted into the top rail and wherein the sidewall does not contact the latch bolt.

According to yet another aspect of the invention, the top rail has a header slot and the housing includes means for supporting the housing in the header slot. Each header slot defines a pair of header rails and the means for supporting comprises a longitudinal groove on each sidewall. The longitudinal groove is adapted to receive the header rail to support the housing in the top rail. In one embodiment, the housing further comprises a cover having longitudinal edges. The sidewalls depend from the cover and are disposed inward of the longitudinal edges. Each sidewall has a sidewall rail that cooperates with a respective one of the housing cover edges to form the longitudinal groove. In another embodiment, each sidewall has a sidewall rib that cooperates with a respective one of the housing cover edges to form the longitudinal groove. Both the sidewall rail and the sidewall rib can be continuous or noncontinuous.

According to a further aspect of the invention, each sidewall has an outer surface and a rib extending from the outer surface, opposite the first segment, wherein the rib is adapted to engage the top rail. In one embodiment, the first segment extends beyond the rib. The rib can have a first inclined surface and a second inclined surface. The first inclined surface is adapted to engage an underside of the top rail when the tilt-latch is installed.

According to another aspect of the invention, the first segment comprises a plurality of first segments and the second segment comprises a plurality of second segments, the first segments and second segments alternating. The rib comprises a plurality of spaced projections wherein a projection is positioned at each first segment.

According to another aspect of the invention, in one embodiment, the tilt-latch is installed by inserting the tilt-latch into the header slot from a side of the top rail. In another embodiment, the tilt-latch is installed by snapping the tilt-latch into the header slot from a top of the top rail.

According to yet another aspect of the invention, the housing has a cover having an underside portion. The gap extends into the underside portion forming a slot therein.

According to a further aspect of the invention, the first segment extends from substantially a top portion of the sidewall to substantially a bottom portion of the sidewall. The tilt-latch is adapted to be inserted into the top rail wherein the first segments flex into the gaps and wherein the first segments of the sidewalls do not contact the latch bolt. The first segments can be flexible to a flexed position during insertion wherein the first segments do not contact the latch bolt. The first segments of the sidewalls are flexible between a first position and a second position as the housing is inserted into the top rail. The sidewalls do not contact the latch bolt if the sidewalls do not return to the first position when the housing is inserted into the top rail. In the configuration of the present invention, movement of latch bolt within the housing is not hindered.

According to yet another aspect of the invention, the respective first segments can flex inward when the housing is installed into the top rail wherein the first segments do not contact the latch bolt to assure free movement of the latch bolt within the housing.

In another embodiment, tilt-latch is adapted to be installed by snapping the latch into the top rail wherein the first segments are flexible from a first position to a second position during installation and wherein the first segments flex back to the first position upon installation wherein the first segments do not contact the latch bolt. In another embodiment, the tilt-latch is adapted to be installed by snapping the latch into the top rail wherein the first segments are flexible from a first position to a second position during installation and wherein the first segments do not flex back to the first position upon installation wherein the first segments do not contact the latch bolt.

Other features and advantages of the invention will be apparent from the following specification taken in conjunction with the following drawings.

DETAILED DESCRIPTION

Figure 1:
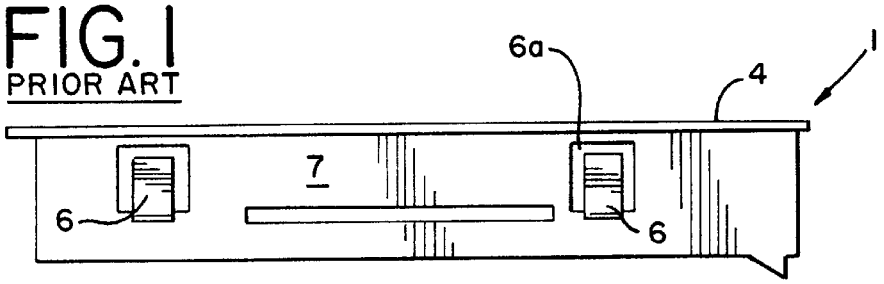
FIG. 1 PRIOR ART
FIG. 1 is a side elevational view of a prior art tilt-latch.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 5:
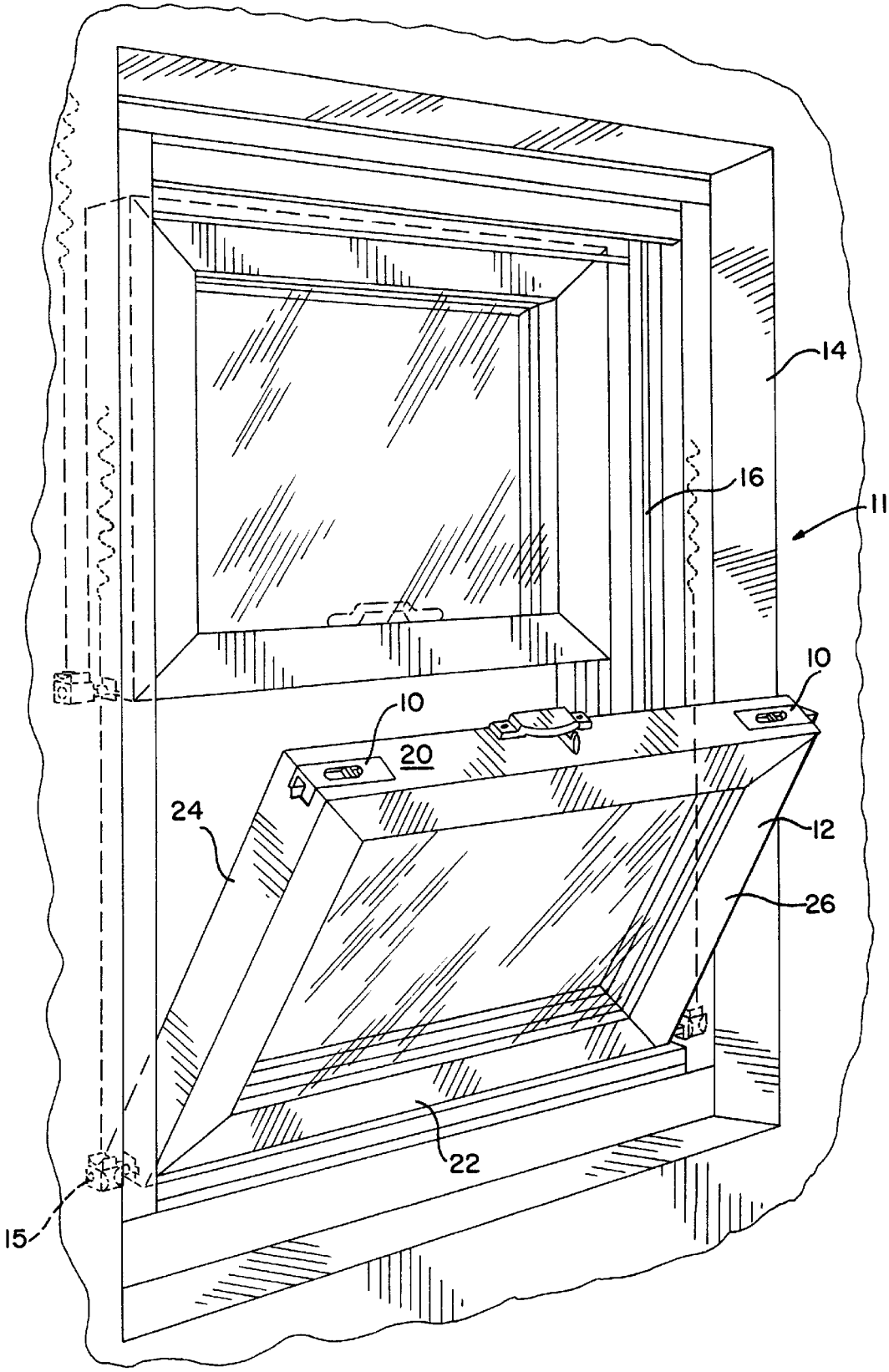
FIG. 5 is a perspective view of a double-hung sash window assembly utilizing a tilt-latch according to the invention.
Figure 14:
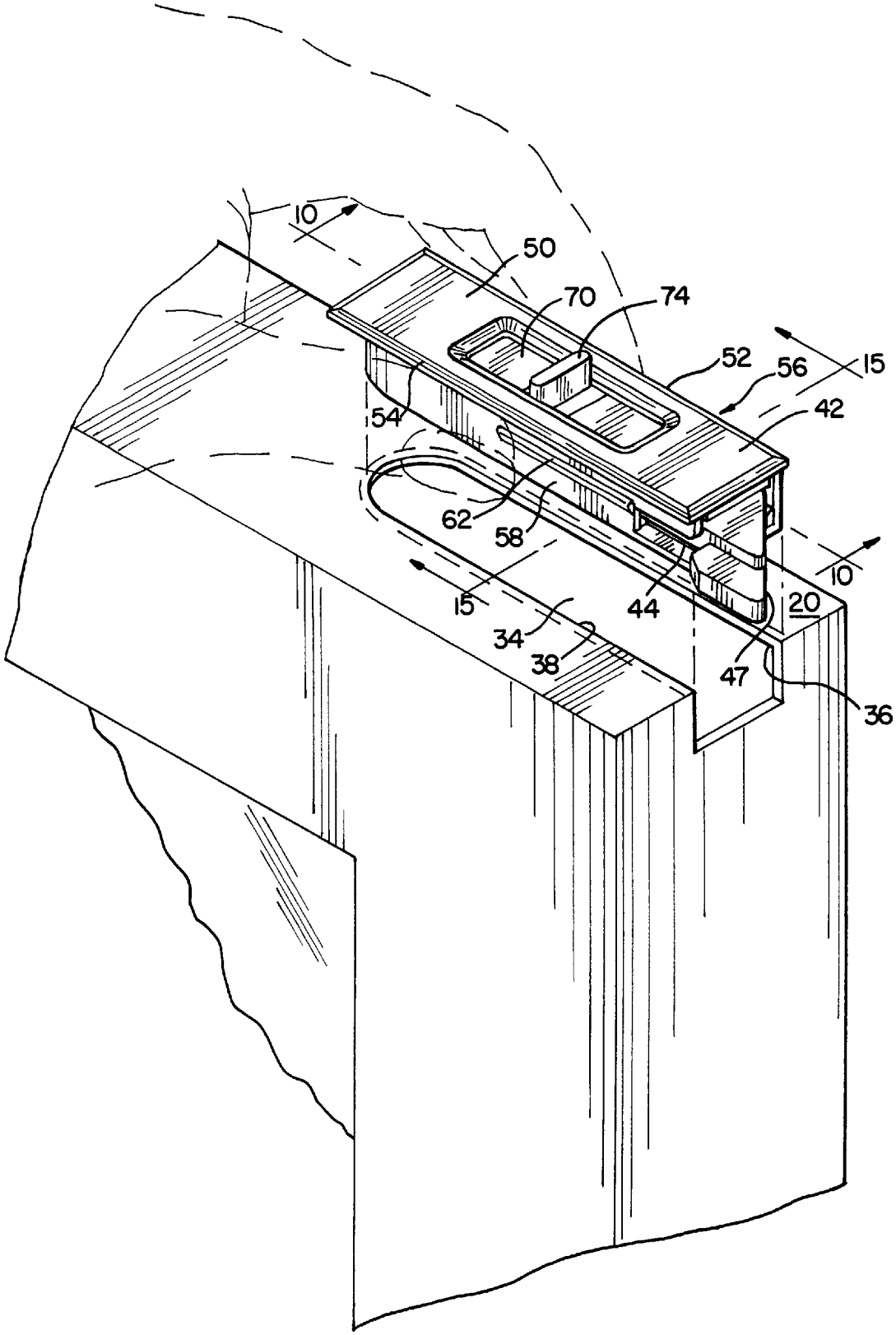
FIG. 14 is a partial perspective view of the tilt-latch being installed in a header slot of a top sash rail.

FIG. 5 shows a tilt-latch of the present invention, generally designated with the reference numeral 10, used in a sash window assembly 11. The sash window assembly 11 shown in FIG. 5 is a double-hung window assembly having a pivotal sash window 12 installed in a master frame 14. The tilt-latch 10 could also be used in other types of pivotal windows or structures. The sash window 12 is pivotally mounted to the master frame 14 by a pivot-corner/balance shoe assembly 15. As is well known, the master frame 14 has opposed, vertically extending guide rails 16. The sash window 12 has a hollow top sash rail 20, a base 22 and a pair of hollow stiles 24,26, cooperatively connected together at adjacent extremities thereof to form a sash frame, typically rectangular although other shapes are possible. The sash frame could be made from extrusions or pulltrusions that are filled with fiberglass, epoxy, plastic, or wood chips. The sash frame could also be solid and, for example, made from wood, aluminum, masonite or pressboard. As shown in FIG. 14, the top sash rail 20 includes a pair of opposing header slots 34 (one shown). It is preferable that the header slots 34 be formed by prepunching the top sash rail 20. Alternatively, the header slots 34 may be formed by routing the hollow top sash rail 20. It is understood that the top sash rail 20, as well as the rest of the frame, could be solid. The top sash rail 20 could then be routed to accommodate the tilt-latch 10. Each of the header slots 34 forms a pair of opposing, longitudinal header rails 36,38. Other methods can be used to so that the top rail 20 can accommodate the tilt-latch 10.

As shown in FIGS. 6–11, the tilt-latch 10 generally comprises a housing 42, a latch bolt 46 having an actuator 48 thereon, and a spring 50. As shown in FIGS. 6–9, the housing 42 is adapted to be supported by the top rail 20. In a preferred embodiment, the housing 42 is designed to be "flush-mounted" in the top rail 20. The latch bolt 46 is disposed within the housing 42. The actuator 48 is, in a preferred embodiment, separately connected to the latch bolt 46. It is understood that the actuator could be integrally molded to the latch bolt 46 or the latch bolt 46 could alternatively be designed to be directly actuated. The actuator 48 is designed to retract the latch bolt 46 into the housing 42 against the biasing force of the spring 50.

Figure 6:
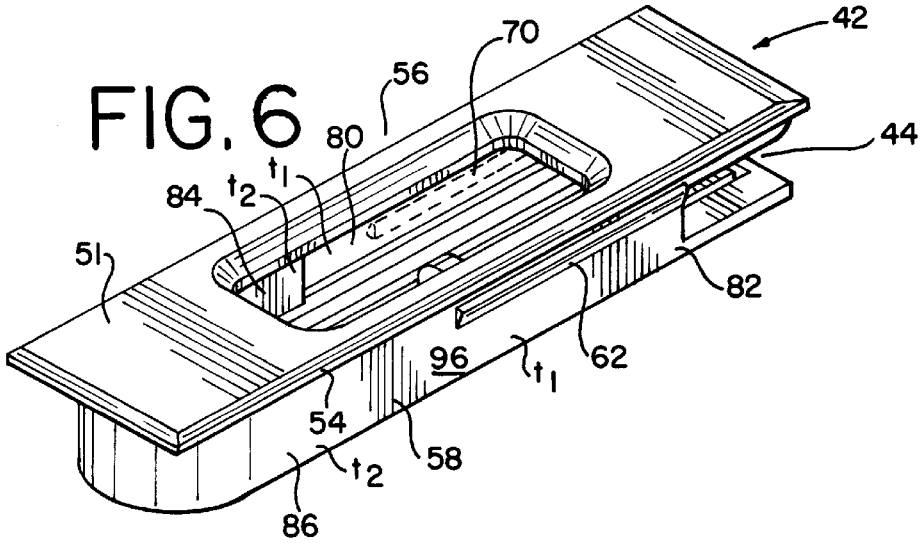
FIG. 6 is a perspective view of the housing of the tilt-latch of the present invention.
Figure 7:
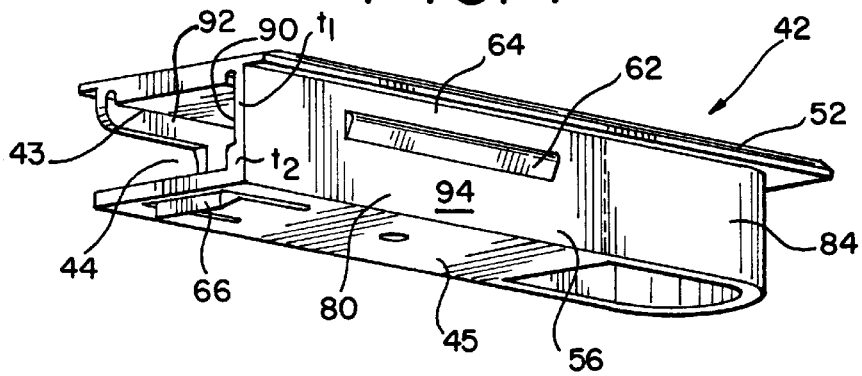
FIG. 7 is another perspective view of the housing of the tilt-latch of the present invention.
Figure 8:
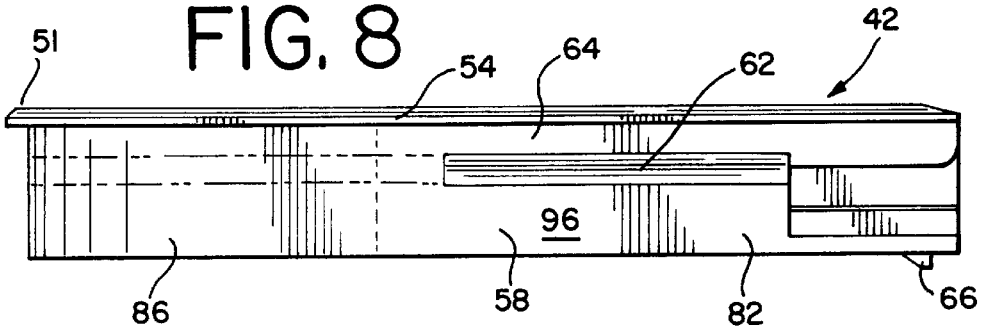
FIG. 8 is a side elevational view of the tilt-latch housing.
Figure 9:
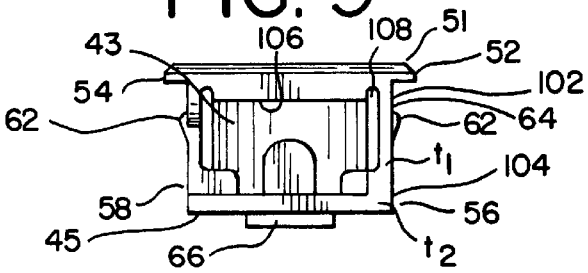
FIG. 9 is a front end view of the tilt-latch housing.
Figure 10:
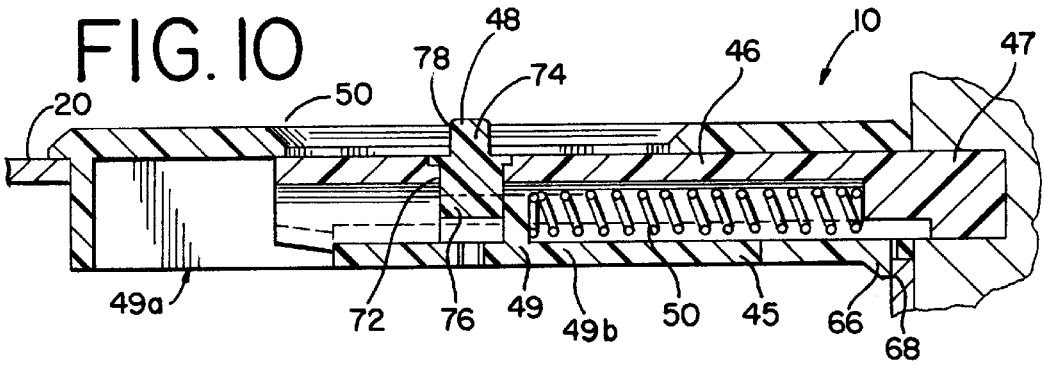
FIG. 10 is a partial cross-sectional view of the tilt-latch taken along the line 10—10 of FIG. 14 and installed in the top rail, the tilt-latch being shown with the latch bolt in an extended position.
Figure 11:
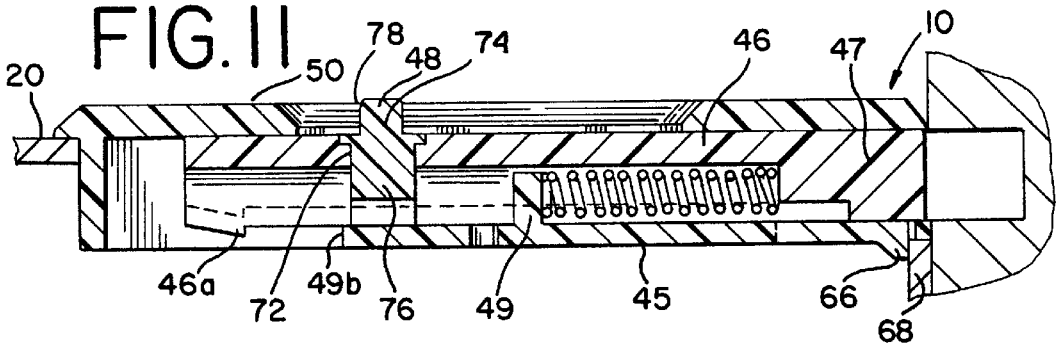
FIG. 11 is a partial cross-sectional view of the tilt-latch of FIG. 10, the tilt-latch being shown with the latch bolt in a retracted position

As shown in FIGS. 6–9, in a preferred embodiment, the housing 42 generally has a box-type structure defining a chamber 43 therein. The housing 42 has a cover 51 having opposing longitudinal edges 52,54. A pair of sidewalls 56,58 depend from the cover 51 and are preferably spaced inward of the respective longitudinal edges 52,54. The housing 42 further has a bottom wall 45 connected to the sidewalls 56,58. If desired, the tilt-latch 10 could be designed wherein the housing 42 has an open bottom end with no bottom wall 45. The cover 51, sidewalls 56,58 and bottom wall 45 cooperate to form the chamber 43 within the housing 42. As shown in FIGS. 6 and 7, the housing 42 has an outward end opening 44 in communication with the chamber 43. The bottom wall 45 has a spring wall 49 that extends into the chamber 43. The bottom wall 45 preferably does not extend the entire distance of the housing 42 thus providing an opening 49*a* (FIGS. 10, 11). The opening 49*a* provides a stop surface 49*b* for the latch bolt 46.

The housing 42 is preferably of a one-piece construction. The one-piece construction strengthens the housing 42 and simplifies assembly. The housing 42, however, could also be made from multiple pieces. In addition, while a box-type housing structure is preferred, the housing 42 could also take other forms. For example, the housing 42 could not include a bottom wall 45 and have other means for retaining the latch bolt 46 in the housing 42. The spring 50 can be held in the housing 42 a number of different ways as known in the art.

As shown in FIGS. 6–9, the housing 42 has structure wherein the housing 42 is adapted to be supported by the top rail 20. In one preferred embodiment, each of the sidewalls 56,58 has a sidewall rib 62 that cooperates with a respective one of the housing cover longitudinal edges 52,54, to form a longitudinal groove 64 adapted to cooperatively receive a respective one of the header rails 36,38. The sidewall rib 62 could be continuous, or alternatively, noncontinuous and comprise a plurality of spaced projections to form a noncontinuous groove with the cover 51. The housing cover longitudinal edges 52,54 could also be either continuous or noncontinuous. The sidewall rib 62 could also comprise one projection at a front portion of the sidewall and another projection on a rear portion of the sidewall to cooperatively form the groove 64 with the cover 51. The sidewall rib 62 has a unique configuration that will be described in greater detail below. In another embodiment, the sidewall rib 62 could comprise a sidewall rail 62 having a rectangular structure such as shown in U.S. Pat. No. 5,139,291. The sidewall rail 62 could also be continuous or noncontinuous. In addition, the housing 42 could be supported by an intermediate wall or bottom wall of the top sash rail 20 and not receive support from a top surface of the top rail 20.

As shown in FIG. 7, the housing 42 could include a depending tab 66 for engaging an inner surface of a respective one of the stiles 24,26 when installed in the sash window frame. The depending tab 66 preferably extends from a flexible member cut, molded or cast, or otherwise formed in the bottom wall 45 of the housing 42. The tab 66, however, could also be a tab that rigidly extends from the bottom wall 45. The housing 42 could also have a screw hole for fastening to the top rail 20 such as if the sash frame 12 was solid. In addition, a tab could depend from the latch bolt 46 as opposed to the housing 42.

As shown in FIGS. 10 and 11, the latch bolt 46 is an elongated piece and is disposed within the housing 42. The latch bolt 46 preferably has a beveled nose portion 47 to permit pivotal shutting of the sash window 12 (See FIG. 14). The latch bolt 46 has a channel on its underside that cooperates with the housing bottom wall 45 to encapsulate the spring 50. Other means can be used to support the spring 50 within the housing 42. The spring 50 has one end abutting the latch bolt and another end abutting the spring wall 49 wherein the spring 50 biases the latch bolt 46 outwardly through the outward end opening 44. The nose portion 47 is adapted for engaging a respective one of the guide rails 16. The latch bolt 46 further has a pair of tabs 46*a* that abut the stop surface 49*b* on the bottom wall 45 of the housing 42.

The cover 51 of the housing 42 has an elongated opening 70. The latch bolt 46 may include a transverse slot 72. In a preferred embodiment, the actuator 48 comprises a control button 74. The control button 74 has a first end 76 securely received within the slot 72 and a second end 78 extending away from the slot 72 and outwardly through the elongated opening 70. The control button 74 entirely fills the slot 72, to prevent deflection of the latch bolt 46 when depressing the control button 74. Alternatively, the slot 72 could be enlarged, and the control button 74 eliminated, to permit an operator's finger to directly retract the latch bolt 46. In such case, a second bump or friction rib could be added to be contacted by an operator's fingernail to assist in retracting the latch bolt 46. The control button 74 could also be integral with the latch bolt 46.

Figure 12:
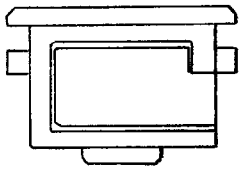
FIG. 12 PRIOR ART
FIG. 12 is a front end view of a prior art tilt-latch.
Figure 13:
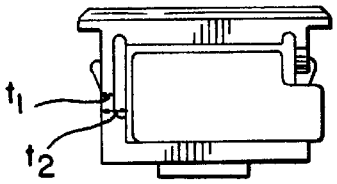
FIG. 13 is a front end view of the tilt-latch of the present invention.
Figure 15:
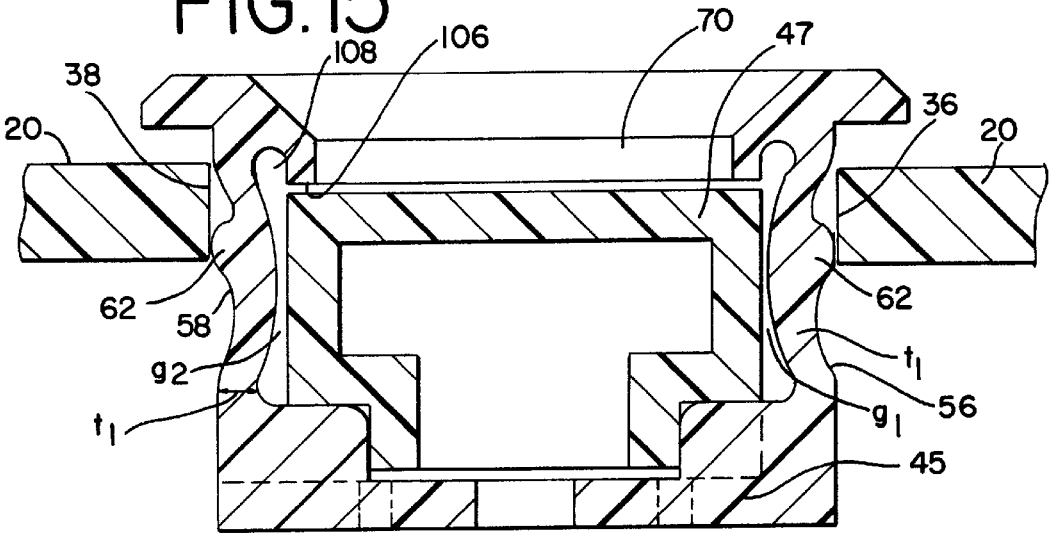
FIG. 15 is a partial cross-sectional view of the tilt-latch being installed in the header slot, taken along lines 15—15 of FIG. 14.
Figure 16:
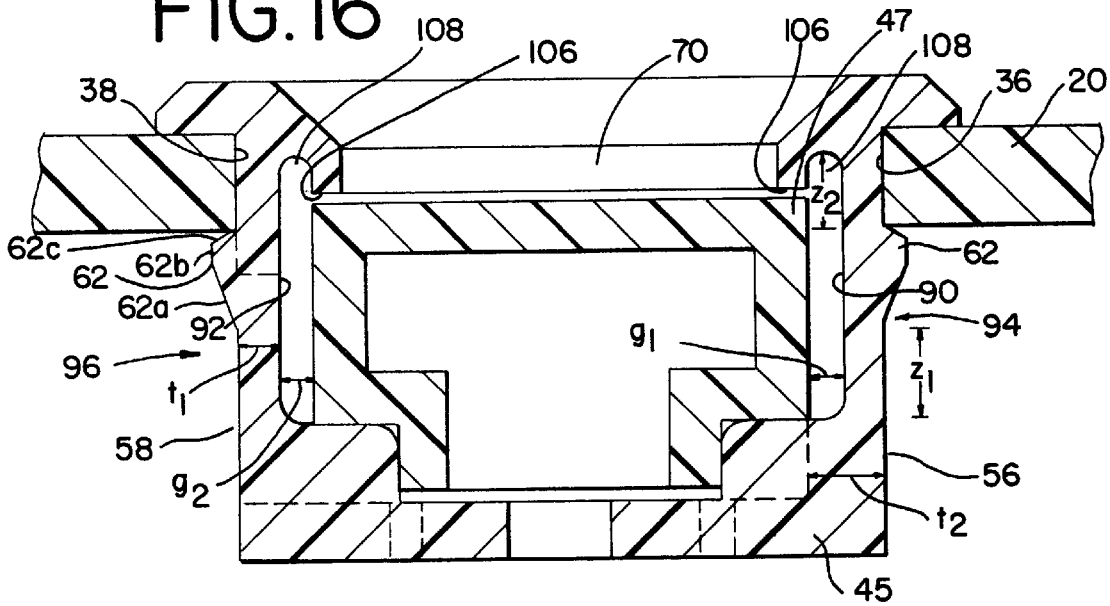
FIG. 16 is a partial cross-sectional view of the tilt-latch of FIG. 15 installed in the header slot.
Figure 17:
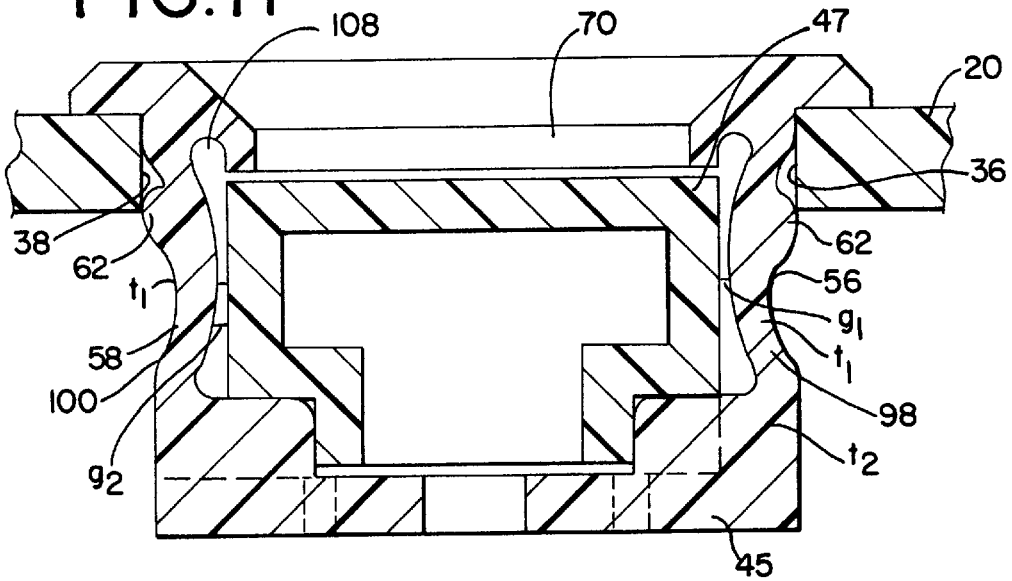
FIG. 17 is another partial cross-sectional view of the tilt-latch installed in the header slot.

As discussed above with prior art tilt-latches, during installation, or after installation, a portion of the housing can contact the latch bolt and bind or restrict movement of the latch bolt within the housing. The housing 42 of the present invention has a unique structure that minimizes the possibility that the movement of the latch bolt 46 will be hindered or obstructed by the housing 42. As shown in FIGS. 6–9 and 13–17, the sidewalls 56,58 have a thinned out portion along the length of the sidewalls 56,58. In particular, each sidewall 56,58 has a first segment 80,82 and a second segment 84,86. The first segments 80,82 have a first thickness $t_1$ and the second segments 84,86 have a second thickness $t_2$. The first thickness $t_1$ is lesser than the second thickness $t_2$. In the prior art latch shown in U.S. Pat. No. 5,139,291 (FIG. 12), the sidewalls generally have a uniform thickness corresponding to the second thickness $t_2$. If desired, the entire sidewalls 56,58 and rear wall of the housing 42 can be molded to the thickness $t_1$ and achieve the benefits of the present invention. When the latch bolt 46 of the present invention is inserted into the housing 42, the lesser thickness $t_1$ of the first segments 80,82 provide a gap between each sidewall 56,58 and the latch bolt 46. Specifically, as shown in FIGS. 13–17, a first gap g1 is provided between the first segment 80 of the sidewall 56 and the latch bolt 46, and a second gap g2 is provided between the first segment 82 of the sidewall 58 and the latch bolt 46. In a preferred embodiment, the first segments 80,82 are positioned towards a front portion of the housing 42 towards the outward end opening 44. As shown in FIGS. 15–17, the sidewall ribs 62 are positioned on the sidewalls 56,58 at the first segments 80,82. It is understood that the sidewall rib can extend further along the length of the sidewalls 56, 58 (FIG. 8). In one preferred embodiment, the ribs 62 comprise a single projection positioned substantially at a midportion of the sidewalls 56,58. As described in greater detail below, the first segments 80,82 may have a greater length than the ribs 62 and thus extend beyond the length of the ribs 62. Alternatively, a slot could be formed around end portions of the ribs 62 to assure adequate flexing as described below. The first segments 80,82 are also flexible.

Thus, as further shown in FIGS. 15–17, the sidewalls 56,58 each have an inner surface 90,92 and an outer surface 94,96. The inner surfaces 90,92 have a recessed portion 98,100. The recessed portions 98,100 preferably correspond to the first segments 80,82. The recessed portions 98,100 have the first thickness $t_1$ thus providing the gaps $g_1$,$g_2$ between the sidewalls 56,58 and the latch bolt 46. As will be described in greater detail, the recessed portions 98,100 are flexible to a flexed position both during installation and after installation. The sidewall ribs 62 extend from the outer surfaces 94,96 of the sidewalls and are adapted to engage the top rail 20.

Figure 2:
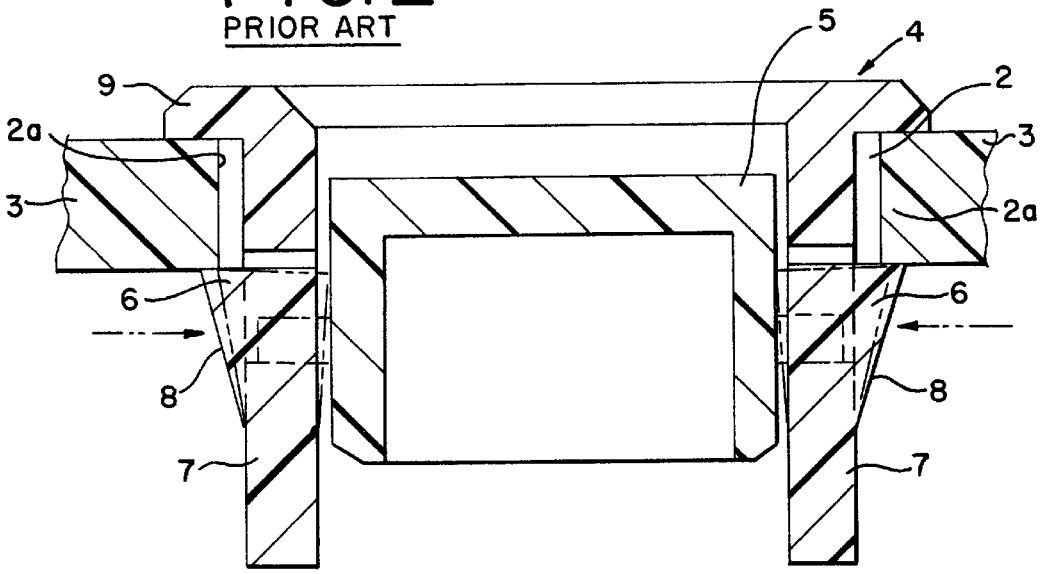
FIG. 2 PRIOR ART
FIG. 2 is a partial cross-sectional view of a the prior art tilt latch of FIG. 1 installed in a header a top sash rail.
Figure 3:
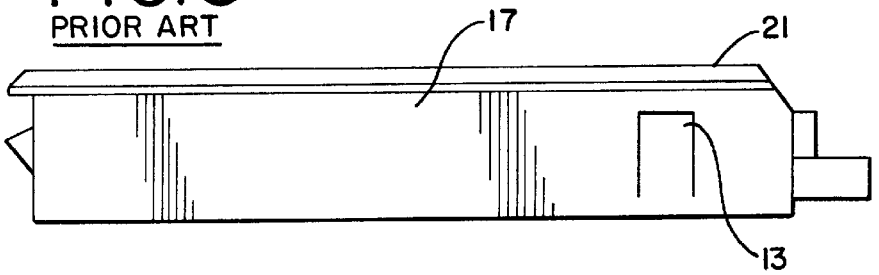
FIG. 3 PRIOR ART
FIG. 3 is a side elevational view of another prior art tilt-latch.
Figure 4:
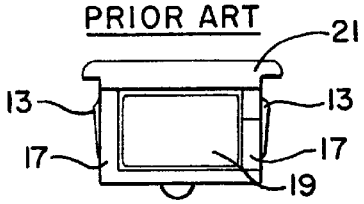
FIG. 4 PRIOR ART
FIG. 4 is an end view of the prior art tilt-latch of FIG. 3.

As further shown in FIGS. 15–17, the sidewalls 56,58 including the first segments 80,82 are preferably solid. For example, no slots are required to be cut around the rib 62 as in the prior-art latch of FIGS. 1 and 2. The sidewalls 56,58 could still be considered solid if small apertures were provided for reasons unrelated to the rib 62 structure. As shown in FIGS. 9 and 16, the first segments 80,82 preferably extend from substantially a top portion 102 of the sidewalls 56,58 to substantially a lower portion 104 of the sidewalls. The cover 51 of the housing 42 has an underside portion 106. The first segments 80,82 may extend to the cover 51 and, thus, the gaps $g_1$,$g_2$ extend into the underside portion 51 forming slot 108 therein. This allows greater flexing as will be described below.

As further shown in FIGS. 15–17, the first segments 80,82 and second segments 84,86 are planar, vertical members and may be positioned adjacent one another. It is understood that the segments could be spaced by a slot. The respective segments of each sidewall 56,58 occupy a vertical plane defined by the respective second segments 84,86. No portion of the sidewalls 56,58 extend beyond the vertical plane. The sidewall rib 62, however, does extend from the sidewall 56,58 and beyond the vertical plane.

As may be seen in FIG. 16, the sidewall rib 62 is adapted such that the housing 42 may be easily mounted in the top rail 20. Specifically, in the preferred embodiment, the rib 62 is comprised of a first surface 62*a* that inclines upwardly and away from the sidewall 56,58 of the housing 42. The rib 62 also has a second surface 62*b* that extends generally parallel to the sidewall 56,58, and a third surface 62*c* extending at a slope upwardly and toward the sidewall 56,58 of the housing 42. While this configuration is preferred, the rib 62 could also assume the configuration shown in FIG. 12 or other configurations.

FIGS. 14–17 illustrate the installation of the tilt-latch 10. It is preferable that the tilt-latch 10 be installed by inserting the tilt-latch into the top rail 20 from the top. In this respect, as shown in FIG. 14, the tilt-latch 10 is affixed to the top sash rail 20 by pushing the tilt-latch 10 into the header slot 34 wherein the sidewalls 56,58 deflect as they engage the respective header rails 36,38 and then return to their original position when the latch is fully installed. As the sidewalls 56,58 are resiliently deflectable, this installation configuration can sometimes be referred to as "snapping" the tilt-latch into the top rail 20. However, the tilt-latch 10 may also be installed by sliding the tilt-latch 10 into the header slot 34 from an end of the stile 24, 26, or side of the top rail 20. In order to mount the housing 42 in the top rail 20 it is necessary to depress the sidewalls 56,58 of the housing 42.

As previously discussed, no appreciable significant gap exists between the latch bolt and the housing sidewalls in the prior art tilt-latches. Therefore, when the sidewalls flex during installation of the prior art tilt-latch, there exists substantial surface-to-surface engagement with the latch bolt. Conversely, as shown in FIGS. 15–17, such surface-to-surface engagement does not need to occur in the present invention. This assures free movement of the latch bolt is not hindered.

As shown in FIGS. 13–17, in one preferred embodiment, at least a portion of each of the sidewalls 56,58 has a lesser thickness $t_1$ than a remaining portion of the sidewalls $t_2$. Accordingly, when the sidewalls 56,58 are depressed a clearance is provided between the sidewalls 56,58 and the latch bolt 46. The clearance is provided by the reduced thickness $t_1$ of the sidewalls 56,58 which compensates for any potential bowing. The reduced thickness $t_1$ also allows for structural flexibility in the sidewalls 56,58. As may be seen in FIGS. 6–8, the thinned segment of the sidewall 56,58 preferably extends along a greater length of the inside of the sidewall 56,58 than the corresponding length extended on the outside of the sidewall 56,58 by the rib 62. Because the thinned segment of the sidewall 56,58 is, in effect, longer than the rib, optimum flexing of the sidewalls 56,58 is assured. Alternatively, a slot could be cut around end portions of the rib to assure optimum flexing. Unlike the prior-art tilt-latches, the sidewall 56,58 construction of the present tilt-latch 10 prevents the latch bolt 46 from being obstructed by the sidewalls 56,58 as it is retracted through the outward end opening 44 (see FIG. 2).

It is further understood that in one preferred embodiment the housing 42 includes sidewalls 56,58 having portions of a lesser thickness $t_1$. The housing 42, however, could be constructed wherein the entire sidewall 56,58 is constructed of the thickness $t_1$ that will allow the sidewalls 56,58 to flex as previously explained.

As can be appreciated, the structure of the sidewalls 56,58 and ribs 62 are designed so that the sidewalls 56,58 are resiliently deflectable wherein the sidewalls 56,58 will return substantially to their original positions after deflection. To this end, the thickness $t_1$ and certain lengths of the sidewalls 56,58 where the flexing occurs are sized to certain "flex ratios." For example, a first wall distance $z_1$ is defined from a bottom portion of the rib 62 to where the sidewall 56,58 meets the bottom wall 45. A second wall distance $z_2$ is defined from a top portion of the rib to the top of the slot 108 in the underside of the cover 106. The points where the sidewalls 56,58 meets the bottom and top of the housing 42 are considered fixed ends. A flex ratio is defined as the ratio of the wall length to the wall thickness (z/t). The flex ratios are determined such that for the material used, when the sidewalls 56,58 flex, the flexure does not induce into the fixed ends a stress that would overcome the elastic properties of the material wherein the sidewalls 56,58 would reach plastic deformation and not substantially return to their original position. Engineering design guides can assist one skilled in the art in determining a proper flex ratio for the material used. For example, in one preferred embodiment wherein the housing 42 is made from nylon, the flex ratio is preferably approximately 1.5 or greater. It is also appreciated that because the sidewalls 56,58 are fixed at both a top portion and a bottom portion, strength is added to the housing 42 because the fixed ends provide resistance to deflection. In addition, the angled configuration of the sidewall rib 62 makes it more difficult for one to pull the tilt-latch from the top sash rail 20.

Because the sidewalls 56,58 are flexible between a first position and a second position, the pressure applied to the sidewalls 56,58 generally causes the sidewalls 56,58 to flex inwardly. When the sidewalls 56,58 are flexed inwardly, the sidewalls 56,58 need not contact the latch bolt 46. Once the housing 42 is secure within the top rail 20, the spring memory of the material from which the housing 24 is constructed forces the sidewalls 56,58 to resume their original positions. Specifically, the first inclined surface 62*a* of the rib 62 engages the header rail and forces the sidewalls 56,58 to flex, or deflect inward. As shown in FIG. 16, once the rib 62 moves beyond the header rail, the sidewalls 56,58 of the housing 42 snap back to generally their original configuration and secure the tilt-latch 10 within the top rail 20.

As may be seen in FIG. 17, there may be instances where the sidewalls 56,58 of the tilt-latch 10 remain in the "flexed position" when the tilt-latch 10 is completely installed in the top rail 20. In particular, the tilt-latch 10 may remain in the flexed position if the header slot 34 and the housing 42 of the tilt-latch 10 do not achieve a most optimum fit. This can sometimes occur due to variations in the respective manufacturing processes. As shown in FIG. 17, the sidewalls 56,58 are adapted such that, even if the sidewalls 56,58 remain in the flexed position, the sidewalls 56,58 do not contact the latch bolt 46. Thus, even if the sidewalls 56,58 do not return to the first position, either because of a less optimal fit or an flaw in installation, the sidewalls 56,58 preferably do not contact the latch bolt 56. In the unlikely event that a sidewall 56,58 does flex and contacts the latch bolt 46, the engagement will not be such that the sidewall 56,58 restricts movement of the latch bolt 46. This allows free movement of the latch bolt unlike prior art tilt-latches such as in FIGS. 1 and 2. Thus, there may be some instances wherein when the sidewalls 56,58 flex, they contact the latch bolt 46. The thickness of the sidewalls 56,58, however, are sized such that regardless of any contact or engagement, movement of the latch bolt 46 is not restricted.

Figure 18:
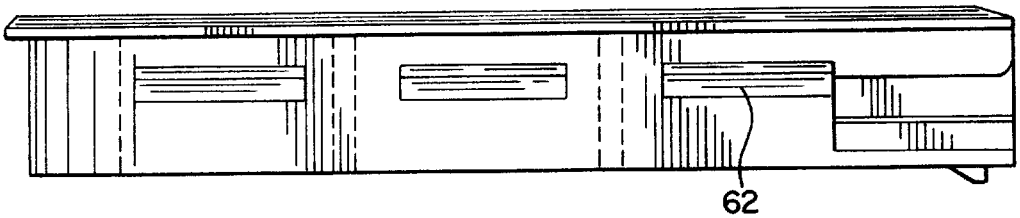
FIG. 18 is a side elevational view of another embodiment of the housing of the tilt-latch of the present invention.

FIG. 18 discloses another embodiment of the tilt-latch housing. The sidewall rib 62 comprises a plurality of ribs or spaced projections. In addition, the first segment 80 having a lesser thickness also comprises a plurality of first segments. The location of the respective first segments and ribs correspond in opposing relation. Also, the first segments extend farther than the rib to assure optimum flexing. A plurality of second segments are positioned between the first segments wherein the first and second segments alternate.

While the specific embodiments have been illustrated and described, numerous modifications come to mind without significantly departing from the spirit of the invention and the scope of protection is only limited by the scope of the accompanying Claims.

We claim:

1. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening;

a latch bolt disposed within the housing and having a nose adapted for engaging a respective one of the guide rails; and the housing further having a sidewall confronting the latch bolt, the sidewall having a first segment and a second segment, the first segment having a lesser thickness than the second segment providing a gap between the sidewall and the latch bolt, wherein the tilt-latch is adapted to be inserted into the top rail wherein the first segment flexes into the gap when the tilt-latch is inserted into the top rail and wherein the sidewall does not restrict movement of the latch bolt.

2. The tilt-latch of claim 1 further comprising means for biasing the latch bolt through the outward end opening.

3. The tilt-latch of claim 2 wherein the biasing means comprises a spring positioned between the latch bolt and the housing.

4. The tilt-latch of claim 1 further comprising an actuator connected to the latch bolt.

5. The tilt-latch of claim 1 further comprising a tab extending from the housing for engaging a respective one of the stiles.

6. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening; the housing further having a pair of sidewalls;

a latch bolt disposed within the housing and having a nose adapted for engaging a respective one of the guide rails; and the sidewalls each having a first segment and a second segment, the first segment having a lesser thickness than the second segment providing a gap between each sidewall and the latch bolt, the sidewalls each having an outer surface and a rib extending from the outer surface opposite the first segment, the rib adapted to engage the top rail.

7. The tilt-latch of claim 6 further comprising means for biasing the latch bolt through the outward end opening.

8. The tilt-latch of claim 7 wherein the biasing means comprises a spring positioned between the latch bolt and the housing.

9. The tilt-latch of claim 6 further comprising an actuator connected to the latch bolt.

10. The tilt-latch of claim 6 further comprising a tab extending from the housing for engaging a respective one of the stiles.

11. The tilt-latch of claim 6 wherein the top rail has a header slot and the housing includes means for supporting the housing in the header slots.

12. The tilt-latch of claim 11 wherein each header slot defines a pair of header rails and the means for supporting comprises a longitudinal groove on each sidewall, the longitudinal groove adapted to receive the header rail to support the housing in the top rail.

13. The tilt-latch of claim 12 wherein the housing further comprises a cover having longitudinal edges, the sidewalls depending from the cover and disposed inward of the longitudinal edges, each sidewall having a sidewall rail that cooperates with a respective one of the housing cover edges to form the longitudinal groove.

14. The tilt-latch of claim 12 wherein the housing further comprises a cover having longitudinal edges, the sidewalls depending from the cover and disposed inward of the longitudinal edges, each sidewall having a sidewall rib that cooperates with a respective one of the housing cover edges to form the longitudinal groove.

15. The tilt-latch of claim 12 wherein the tilt-latch is adapted to be installed by inserting the tilt-latch into the header slot from a side of the top rail.

16. The tilt-latch of claim 12 wherein the tilt-latch is adapted to be installed by inserting the tilt-latch into the header slot from a top of the top rail.

17. The tilt-latch of claim 6 wherein the first segment extends beyond the rib.

18. The tilt-latch of claim 6 wherein the rib has a first inclined surface and a second inclined surface, the first inclined surface adapted to engage an underside of the top rail when the tilt-latch is installed.

19. The tilt-latch of claim 6 wherein the rib is continuous.

20. The tilt-latch of claim 6 wherein the rib comprises a plurality of spaced projections.

21. The tilt-latch of claim 6 wherein the first segment comprises a plurality of first segments and the second segment comprises a plurality of second segments, the first segments and second segments alternating, the rib comprising a plurality of spaced projections wherein a projection is positioned at each first segment.

22. The tilt-latch of claim 6 wherein the rib comprises a single projection positioned substantially at a midportion of the sidewall.

23. The tilt-latch of claim 6 wherein the housing has a cover having an underside portion, the gap extending into the underside portion forming a slot therein.

24. The tilt-latch of claim 6 wherein the first segment extends from substantially a top portion of the sidewall to substantially a bottom portion of the sidewall.

25. The tilt-latch of claim 6 wherein the tilt-latch is adapted to be inserted into the top rail wherein the first segments flex into the gaps and wherein the first segments of the sidewalls do not restrict movement of the latch bolt.

26. The tilt-latch of claim 6 wherein the tilt-latch is adapted to be inserted into the top rail, the first segments being flexible to a flexed position during insertion wherein the first segments do not contact the latch bolt.

27. The tilt-latch of claim 6 wherein the first segments of the sidewalls are flexed from a first position to a second position as the housing is inserted into the top rail, wherein the first segments flex back to an intermediate position between the first position and the second position when the housing is inserted into the top rail, wherein the sidewalls do not restrict movement of the latch when the first segments are in the intermediate position.

28. The tilt-latch of claim 6 wherein the respective first segments can flex inward when the housing is installed into the top rail wherein the first segments do not contact the latch bolt to assure free movement of the latch bolt within the housing.

29. The tilt-latch of claim 6 wherein the tilt-latch is adapted to be installed by inserting the latch into the top rail wherein the first segments flex from a first position to a second position during installation and wherein the first segments flex back to the first position upon installation wherein the first segments do not contact the latch bolt.

30. The tilt-latch of claim 6 wherein the tilt-latch is adapted to be installed by snapping the latch into the top rail wherein the first segments flex from a first position to a second position during installation and the top rail adapted to prevent the first segments from flexing back to the first position wherein the first segments flex back to an intermediate position upon installation wherein the first segments do not restrict movement of the latch bolt.

31. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening;

a latch bolt disposed within the housing and having a nose adapted for engaging a respective one of the guide rails;

the housing further having a sidewall, the sidewall having an inner surface and an outer surface uninterrupted by openings, wherein the tilt-latch is adapted to be installed by inserting the latch into the top rail wherein the sidewall flexes from a first position to a second position during installation and wherein the sidewall flexes back to the first position upon installation wherein the sidewall does not contact the latch bolt.

32. The tilt-latch of claim 31 wherein the sidewall comprises a pair of sidewalls, each sidewall having an inner surface and an outer surface, the inner surface having a recessed portion providing a gap between the inner surface and the latch bolt.

33. The tilt-latch of claim 32 wherein each outer surface has a rib, the rib adapted to engage the top rail.

34. The tilt-latch of claim 33 wherein the recessed portions can flex inward when the tilt-latch is installed in the top rail and wherein the recessed portions do not contact the latch bolt.

35. The tilt-latch of claim 34 wherein the top rail has a header slot, the tilt-latch is adapted to be installed in the header slot by snapping the tilt-latch into the header slot.

36. The tilt-latch of claim 35 wherein the recessed portions flex from a first position to a second position during installation, wherein the recessed portions flex back to an intermediate position when installed, wherein the recessed portions do not restrict movement of the latch bolt when the recessed portions are in the intermediate position wherein latch bolt movement is not hindered.

37. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening;

a latch bolt disposed within the housing and having a nose adapted for engaging a respective one of the guide rails;

the housing further having a sidewall uninterrupted by openings, the sidewall flexing from a first position to a second position as the housing is installed into the top rail, wherein the sidewall flexes back to an intermediate position when the housing is installed into the top rail wherein the sidewall does not restrict movement of the latch bolt when the sidewall is in the intermediate position.

38. The tilt-latch of claim 37 wherein the sidewall comprises a pair of sidewalls, each sidewall flexing from a first position to a second position as the housing is installed into the top rail, wherein the sidewalls flex back to an intermediate position when the housing is installed into the top rail, wherein the sidewalls do not restrict movement of the latch bolt when the sidewalls are in the intermediate position.

39. The tilt-latch of claim 38 wherein a gap is provided between an inner surface of each sidewall and the latch bolt.

40. A tilt-latch of claim 38 wherein each sidewall has an outer surface, the outer surface having a rib extending therefrom, the rib adapted to engage the top rail.

41. The tilt-latch of claim 37 wherein the sidewalls are flexible inward when the tilt-latch is installed in the top rail and wherein the sidewalls do not contact the latch bolt.

42. The tilt-latch of claim 37 wherein the top rail has a header slot, the tilt-latch is adapted to be installed in the header slot by snapping the tilt-latch into the header slot.

43. A tilt-latch for a sash window disposed within opposed guide rails on a master frame, the sash window comprises a top rail, a base and two stiles connected together at their extremities, the top rail having a header slot, the tilt-latch adapted for releasably securing the sash window to the master frame, the tilt-latch comprising:

a housing having an outward end opening;

a latch bolt disposed within the housing and having a nose adapted for engaging a respective one of the guide rails;

the housing further having a sidewall, the sidewall having an inner surface and an outer surface, the inner surface having a recessed portion occupying a substantially vertical plane and providing a gap between the inner surface and the latch bolt, the tilt-latch adapted to be installed into the top rail by snapping the tilt-latch into the header slot wherein the recessed portion flexes into the gap and wherein the recessed portion does not contact the latch bolt.

44. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening;

a latch bolt disposed within the housing and having a nose adapted for engaging a respective one of the guide rails;

the housing further having a sidewall uninterrupted by openings, the sidewall confronting the latch bolt, the sidewall having an extending rib adapted to engage the top rail, the sidewall being inwardly flexible to a flexed position wherein the sidewall does not contact the latch bolt when the sidewall is in the flexed position.

45. The tilt-latch of claim 44 wherein the sidewall has a first segment and a second segment, the first segment having a lesser thickness than the second segment providing a gap between the sidewall and the latch bolt.

46. The tilt-latch of claim 44 wherein the sidewall comprises a pair of sidewalls, each sidewall having an inner surface and an outer surface, the inner surface having a recessed portion providing a gap between the inner surface and the latch bolt.

47. The tilt-latch of claim 46 wherein the recessed portions can flex inward to the flexed position when the tilt-latch is installed in the top rail and wherein the recessed portions do not contact the latch bolt.

48. The tilt-latch of claim 47 wherein the top rail has a header slot, the tilt-latch is adapted to be installed in the header slot by snapping the tilt-latch into the header slot.

49. The tilt-latch of claim 48 wherein the recessed portions flex from a first position to a second position during installation, wherein the recessed portions flex back to an intermediate position when installed, wherein the recessed portions do not contact the latch bolt when the recessed portions are in the intermediate position wherein latch bolt movement is not hindered.

50. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having a chamber defined by a cover, a pair of sidewalls depending from the cover and a bottom wall connected to the sidewalls, the housing further having an outward end opening in communication with the chamber;

a latch bolt disposed within the chamber and having a nose extending through the outward end opening adapted for engaging a respective one of the guide rails;

the sidewalls of the housing further having a recessed portion providing a gap between each sidewall and the latch bolt, wherein the recessed portions flex inward when the tilt-latch is installed in the top rail wherein the recessed portions do not restrict movement of the latch bolt.

51. The tilt-latch of claim 50 wherein the sidewall comprises a pair of sidewalls, each sidewall having an inner surface and an outer surface, the inner surface having a recessed portion providing a gap between the inner surface and the latch bolt.

52. The tilt-latch of claim 51 wherein each outer surface has a rib, the rib adapted to engage the top rail.

53. The tilt-latch of claim 50 wherein the top rail has a header slot, the tilt-latch is adapted to be installed in the header slot by snapping the tilt-latch into the header slot.

54. The tilt-latch of claim 50 wherein the recessed portions flex from a first position to a second position during installation, wherein the recessed portions flex back to an intermediate position when installed, wherein the recessed portions do not contact the latch bolt when the recessed portions are in the intermediate position wherein latch bolt movement is not hindered.

55. A tilt-latch for a sash window disposed within opposed guide rails on a master frame, the sash window comprises a top rail, a base and two stiles connected together at their extremities, the tilt-latch adapted for releasably securing the sash window to the master frame, the tilt-latch comprising:

a housing adapted to be supported by the top rail, the housing having an outward end opening;

a latch bolt disposed within the housing and having a nose adapted for engaging a respective one of the guide rails;

the housing further having a sidewall, the sidewall confronting the latch bolt and being flexible along a length of the sidewall extending from the outward end opening, the sidewall flexing from a first position to a second position as the housing is installed into the top rail, wherein the sidewall flexes back to an intermediate position when the housing is installed into the top rail, wherein the sidewall does not restrict movement of the latch bolt when the sidewall is in the intermediate position.

56. A tilt-latch for a sash window disposed within opposed guide rails on a master frame, the sash window comprises a top rail, a base and two stiles connected together at their extremities, the top rail having opposed header slots, each header slot having a pair of header rails, the tilt-latch adapted for releaseably securing the sash window to the master frame, the tilt-latch comprising:

a housing having an outward end opening;

a latch bolt disposed within the housing and having a nose adapted for engaging a respective one of the guide rails, the latch bolt having an actuator adapted for engagement for retracting the latch bolt into the housing;

a spring biasing the latch bolt outwardly through the outward end opening;

the housing further having a cover having longitudinal edges and a pair of sidewalls depending from the cover and disposed inward of the longitudinal edges, each of said sidewalls having an inner surface and an outer surface, each outer surface having a sidewall rail that cooperates with a respective one of the housing cover edges to cooperatively receive one of the header rails when the housing is installed into the header slot, each inner surface having a first segment and a second segment, the first segment being opposite the sidewall rail and having a lesser thickness than the second segment to provide a gap between the first segment and the latch bolt, wherein the first segment can flex inward when the housing is installed into the header slot wherein the first segment does not contact the latch bolt; and a tab extending from the housing and adapted to engage one of the stiles.

* * * * *